United States Patent [19]

Walter

[11] 4,328,906

[45] May 11, 1982

[54] CONTAINER AND CLOSURE THEREFOR

[75] Inventor: John Walter, Evergreen Park, Ill.

[73] Assignee: The Continental Group, Inc., Oak Brook, Ill.

[21] Appl. No.: 209,556

[22] Filed: Nov. 24, 1980

[51] Int. Cl.[3] ..... B65D 51/16; B65D 39/00

[52] U.S. Cl. ..... 220/260; 220/307; 220/375; 222/543

[58] Field of Search ..... 220/260, 307, 375, 339, 220/270; 222/543, 565, 569, 566

[56] References Cited

U.S. PATENT DOCUMENTS

| | | | |
|---|---|---|---|
| 3,016,168 | 1/1962 | Larson | 222/543 |
| 3,021,976 | 9/1962 | Tracy | 220/375 X |
| 3,049,264 | 8/1962 | Moranski | 220/395 |
| 3,415,412 | 12/1968 | Robinson | 220/270 |
| 3,532,248 | 10/1970 | Ruekberg | 220/270 |
| 3,744,662 | 7/1973 | Zundel | 222/543 |
| 3,794,207 | 2/1974 | Hunt | 220/36 |
| 3,999,678 | 12/1976 | Ignell | 220/270 |
| 4,171,062 | 10/1979 | Allen | 220/270 |
| 4,220,249 | 9/1980 | Nilsson | 220/375 |
| 4,243,152 | 1/1981 | Ignell | 220/270 |
| 4,280,636 | 7/1981 | Lewis | 220/307 |

*Primary Examiner*—George T. Hall
*Attorney, Agent, or Firm*—John J. Kowalik

[57] ABSTRACT

A closure for a container comprising a leverage mechanism for popping a plug from the neck of the container, the leverage mechanism including a lever which is tethered to the plug and which is arranged to swing over a fulcrum which is provided on the neck, the fulcrum also serving as a lip guide.

13 Claims, 8 Drawing Figures

CONTAINER AND CLOSURE THEREFOR

BACKGROUND OF THE INVENTION

Containers of the type under consideration consist of a cylindrical body with either an integral or seamed bottom and have a domed upper end with a neck which is associated with a closure.

Various closures for the small diameter neck are available. Such closures are shown in U.S. Pat. Nos. 3,251,499, 3,317,070, 3,348,719, 3,998,354, 3,999,678 and 4,149,651.

DESCRIPTION OF THE PROBLEM

After considering various types of snap-in closures of the types heretofore discussed, a number of problems were noted. Some of the most objectionable problems have been the lack of consistent positive closure under pressure and which is also relatively easy to open and simple to adapt to high speed manufacture and application. Structures of the general type under consideration have been heretofore made, but are more bulky and costly and the best references require a closure which must be torn to open. This type of structure requires extremely accurately machined dies and the section to be torn apart must be precisely dimensioned, not only to withhold the pressure but also be capable of rupturing when being tensioned by the pulling effort exerted by the person wanting to open the closure. A further problem arises when good sealing structure is obtained in the difficulty of opening the closure.

SOLUTION OF THE PROBLEM

The snap-close closure of the instant invention has been made not only to minimize the amount of material used but also provides a novel combined venting and opening-facilitating leverage structure with enhanced sealing integrity. This structure is obtained by placing the venting mechanism in a position wherein when the parts are interlocked in closing position, they supplement the closure function and when these parts are separated to vent, the closure portion is unsupported in the area of initial separation and thus is more flexible in this area and readily deflects to release the interlocking parts whereby facilitating opening of the closure. The invention also provides a novel leverage structure to facilitate opening of the closure.

SUMMARY OF THE INVENTION

This invention is directed to closures and, more particularly, to closures for pressurized products.

A main object of the invention is to provide a closure which may be easily inserted into the open end of a container and in which parts in closed position are interrelated to maintain the closure from opening or leaking and upon certain parts being separated during the opening sequence, the container is first vented and other parts are rendered more susceptible to opening.

A further object is to provide a novel closure having several parts tethered to each other and which are reclosable.

Another object is to provide a plastic closure which is made as a single unit in a simple molding operation.

Another object is to provide a novel opening lever arrangement which first opens a vent and then pries the closure open with relatively small effort.

These and other objects inherent in and encompassed by the invention will become more apparent from the specification and the drawings wherein.

DESCRIPTION OF THE INVENTION

Figure 1:
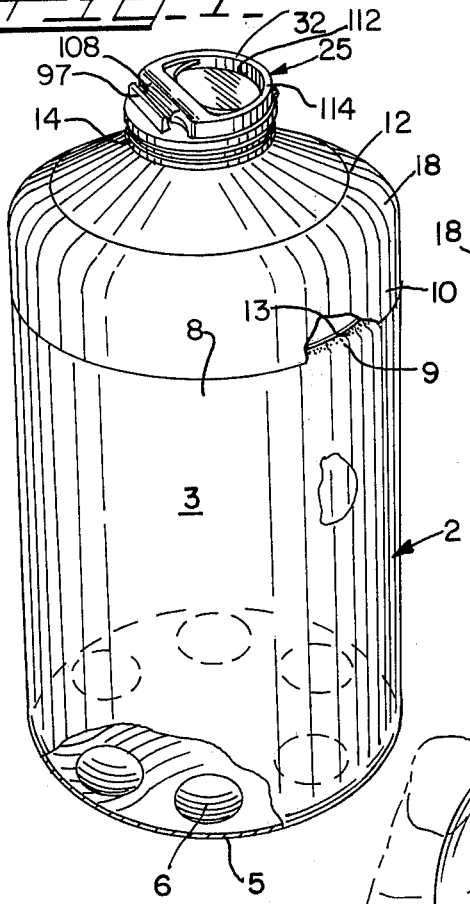
FIG. 1 is a perspective view of the novel container incorporating the invention.
Figure 2:
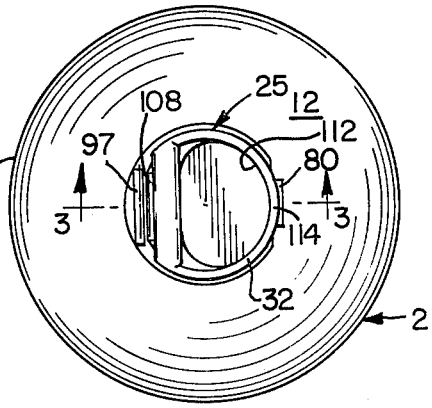
FIG. 2 is a top plan view thereof.

The invention is shown applied to a container 2 made of metal such as aluminum and comprising a cylindrical body 3 with an integral outwardly convexed bottom 5 which is provided with outwardly protruding dimples 6 upon which the container rests. It will be understood that the invention is applicable to other types of containers.

The upper open end portion 8 of the body 3 has a necked-in portion 9 which fits into an annular skirt portion 10 of a dome member 12 which forms the upper end of the container. A suitable adhesive 13 bonds the portion 9 to the skirt 10. The dome member 12 is formed with a stepped neck 14 and a toroidal section 18. The member 12 provides at its neck 14 a shoulder 20 and an access opening 22 (FIG. 4) at the upper end of the container, the neck 14 terminating in a curl 24.

A plastic closure 25 is provided at the upper end of the container and comprises a tubular neck or sleeve portion 26, a closure plug portion 28 and a venting portion 30 to which is attached a finger grip lever or handle 32.

The neck portion 26 is a cylindrical member which at its lower end is tapered at 36 and is tightly wedged through the opening 22 (FIG. 3) and then expands radially outwardly and engages its shoulder 38 under the edge of shoulder 20 of the neck 14.

The neck portion has an upper outwardly projecting annular flange 40 which engages the top edge of the curl 24 and provides a fluid-tight pressure seal with the shoulder 38.

The interior bore surface 50 of the neck portion provides a pour and fill opening and is provided with a locking ring member or shoulder 52 which has a downwardly sloping upper surface 56 merging into an apical edge 58 with a bottom locking surface 60 which extends normal to the axis of the neck portion. Above the ring 52 the bore surface is of frusto-conical shape which widens toward the upper end to facilitate entry of the lower end portion 62 of the closure plug 28.

The plug 28 has a cylindrical side wall 65 which intermediate its upper and lower edges is provided with an annular locking ring or rib 66 which is of generally triangular cross-section having a lower downwardly tapered pilot surface 67 which is adapted to be guided upon engagement with the upper similarly tapered face 56 of the neck or sleeve locking ring 52 past the apex 58 when the plug or cap is pressed into the neck opening or bore 50 whereupon an apical edge 68 is deflected with edge 58 and the locking ring or shoulder 66 on the cap is stepped under the shoulder 52 of the neck and a flat radially outwardly extending surface 69 at the upper end of the shoulder 66, normal to the axis of the neck or sleeve, locks under the face 60.

The plug portion or cap 28 has a top wall 70 integral with the upper end of the plug 28, the wall 70 extending beyond the perimeter of the plug and forms an annular rim portion 72 which on its underside is pressed in position against the top surface 75 of the annular flange 40 integral with and extending radially outwardly from the upper end of the neck portion 26. The bottom side 77 of flange 40 presses against the crest 78 (FIG. 3) of the curl 24 of the metal neck 14.

A tether in the form of a narrow strap 80 connects a peripheral edge of flange 72 with a peripheral edge of portion 40 of the neck member 26.

The wall 70 is provided close to its marginal edge with a vent opening 84 in an area diametrically opposite to the tether 80 adjacent to the interior surface of the wall 65 of the plug.

A frusto-conical pilot cavity 86 is formed at the upper end of opening 84 for guiding the male venting closure pin or element 30 which in the closed position extends into the opening 84.

Figure 4:
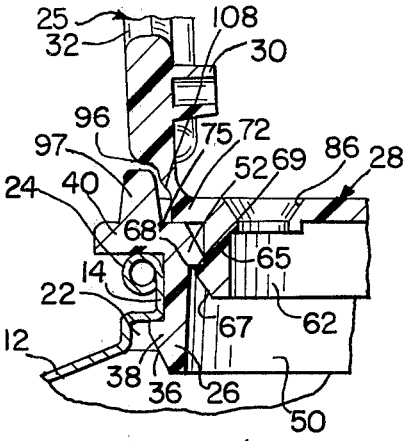
FIG. 4 is a fragmentary enlarged sectional view showing the vent open position of the closure.

The upper end of the closure element or vent pin 30 depends from and is integrally connected with the lever member 32 intermediate its ends. The lever 32 has a fulcrum end 96 which engages with the top edge of a combination pouring lip and fulcrum post 97 formed on the top side of the flange 40. As seen in FIG. 4, the lever 32 is connected below the fulcrum end 96 to one end of a narrow strap 108 which is folded and which has its other end connected to the outer edge of flange 72 in an area diametrically opposite the strap 80.

Figure 9:
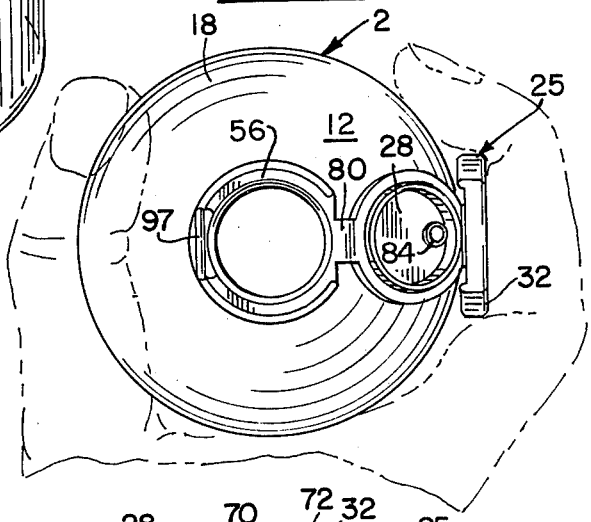
FIG. 9 is a top view with the container and closure hand held in open position.
Figure 3:
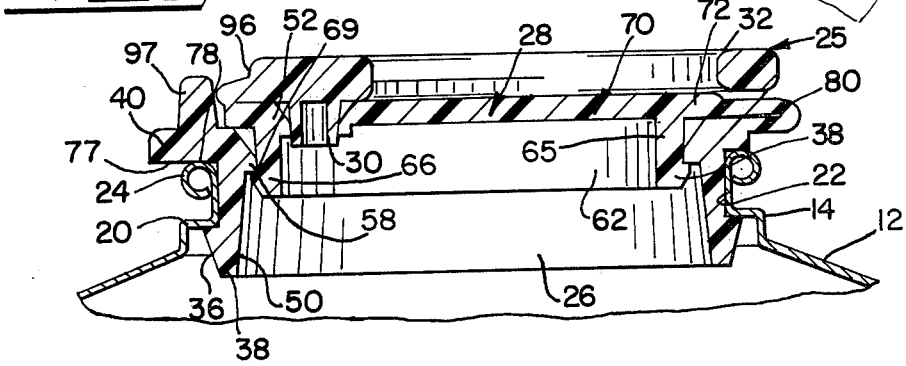
FIG. 3 is an enlarged cross sectional view taken substantially on line 3—3 of FIG. 2.
Figure 5:
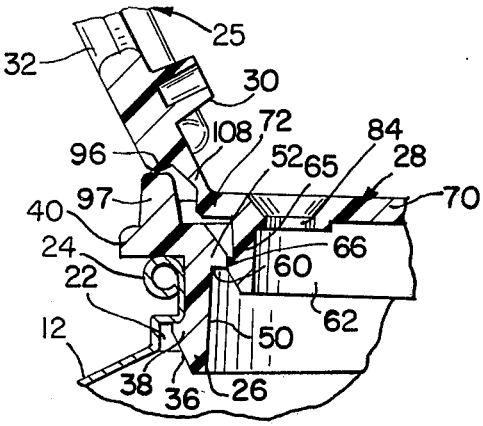
FIG. 5 is a fragmentary enlarged sectional view showing the prying position of the lever.
Figure 6:
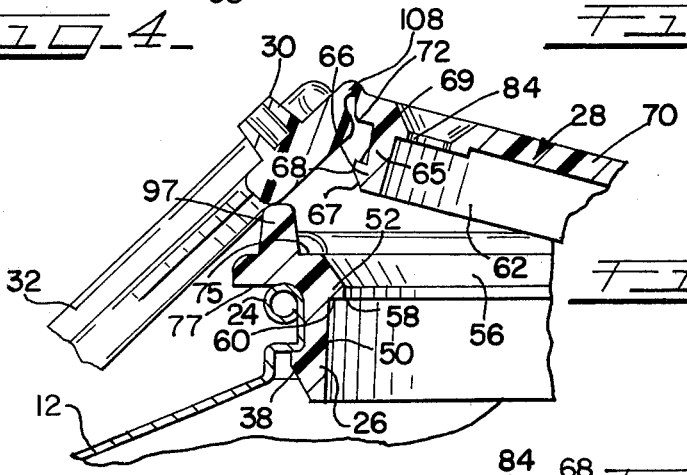
FIG. 6 is a sectional view showing the opening position of the closure.
Figure 7:
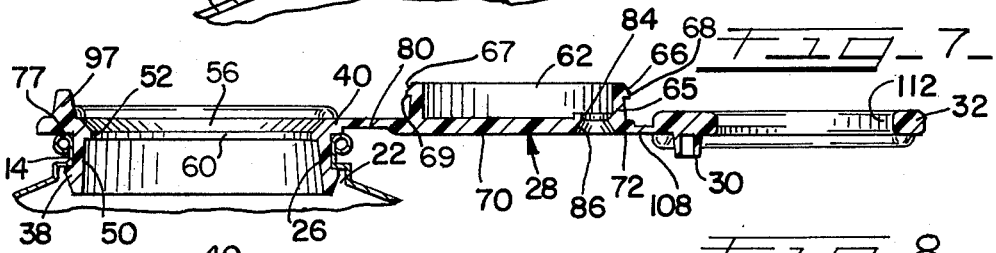
FIG. 7 is a sectional view showing the open position.
Figure 8:
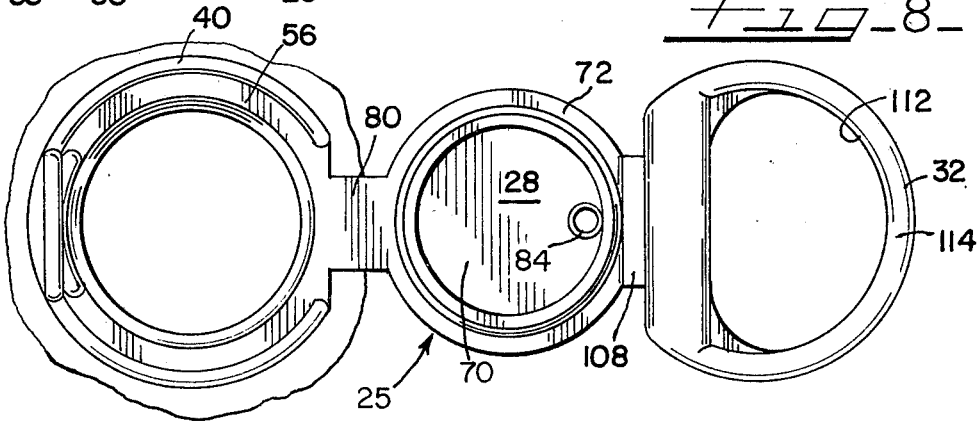
FIG. 8 is a top view of the closure in open position.

Thus, to open the closure shown closed in FIGS. 3 and 4, the user inserts his finger through the ring hole 112 and lifts on portion 114 diametrically opposite the strap 108 thus lifting the fulcrum end portion 96 outwardly and withdrawing the vent plug 30 from opening 84. Continued rotation of the lever or handle engages the fulcrum portion 96 against the post or ledge 97 and further pivotal movement leftwardly (FIGS. 4–6) pries the plug 28 out of the sleeve 26. Removal of the pin or plug 30 removes the support for the plug wall 65 in the immediate area and thus enhances the flexure of that portion of the wall 65, that is, in the region of the vent opening whereby as the lever is fulcrumed, it pulls on the tether 108 which, in turn, curls the adjacent portion 72 of the top wall 70 upwardly and causes the portion of the wall 70 contiguous to the vent opening to warp radially inwardly thus facilitating partially unhooking of the ledge or shoulder 66 from under the shoulder 52 and disengaging the locking face 69 from face 60. The plug 28 then easily lifts out of the neck or sleeve opening and with the handle or lever portion 30 lays to one side of the pour opening 50 and may be grasped by the user as seen in FIG. 9.

To reclose the closure, the plug 28 of the closure is pressed into the sleeve opening until the shoulder 52 snaps under the shoulder 66. Then the handle or lever is folded over the cap 28 and the vent plug or pin 30 is pressed into the vent opening 84.

I claim:

1. A closure for a container having a wall member with an aperture, said closure comprising a sleeve member having a seal-tight fit within said aperture and having a bore providing a pour opening, a flexible plastic plug having a seal-tight fit within said opening, a lift lever connected to said plug, and a combination pour lip and fulcrum projecting from one of said members for fulcruming engagement by said lever upon lifting and tilting thereof to thereby open said pour opening by lifting the plug out of the pour opening.

2. A closure for a container having a wall member with an aperture, a tubular sleeve member having a seal-tight fit within said aperture and providing a pour opening, a resilient plug having, in the closed position, a seal tight fit within said opening, a lift lever, means tethering said lift lever to said plug, said lift lever having a fulcrum end and a lift end, and combination fulcrum and lip guide means on said sleeve member extending axially thereof, said lift lever being swingable over said combination means for prying said plug out of said pour opening.

3. The invention according to claim 2 and first means tethering said plug to said sleeve member.

4. The invention according to claim 3 and second tethering means connecting the lever to the plug being disposed diametrically opposite to said first tethering means.

5. The invention according to claim 2 and said closure being made of plastic.

6. The invention according to claim 2 and said closure comprising vent means including a vent hole in said plug, and a pin connected to said lever and insertable into said vent and withdrawable from the vent hole attendant to the lever being lifted.

7. The invention according to claim 6 and said plug being hollow and having a flexible wall positioned in the closed position of the plug in sealing engagement with said sleeve member, and said pin in the closed position of the vent being disposed in rigidifying relation to said flexible wall of the plug and said pin in the open position of the vent being displaced from said flexible wall whereby said plug is free to be deflected away from its engagement with said sleeve member to facilitate withdrawal of the plug from said sleeve member.

8. A closure for a container having an access aperture, said closure comprising: a sealing element insertable into said aperture and having a bore providing a pour opening, a plug insertable into said pour opening for closing the same, and means for lifting said plug out of said opening to open the same, said means comprising a lever horizontally disposed in overlying relation to the top of said plug in the closed position of the plug, a tether connecting said lever at one of its ends to a peripheral portion of the plug, fulcrum means on said sealing element positioned adjacent to said tether alongside the upper end of the plug in horizontal alignment with said lever for fulcruming engagement by said one end thereof attendant to the opposite end of the lever being lifted, said tether being dimensioned to accommodate said one end of said lever to swing over said fulcrum means and flex said plug and withdraw the plug from said pour opening.

9. The invention according to claim 8 and means tethering said plug to said element.

10. A closure for a container having an aperture, said closure comprising a sleeve fitted into said aperture, means providing a seal between the sleeve and said container, said sleeve having a bore providing a pour opening, a plug having a seal fit with said sleeve in closed position within said opening, a lever overlying said plug in the closed position of the closure, a tether connecting one end of the lever to said plug, and a fulcrum on the sleeve having an upper end positioned for sliding engagement by said lever attendant to said lever being swung beyond a predetermined angle whereupon said lever is caused to pivot on the fulcrum and pull the tether and thus lift said plug out of said opening.

11. The invention according to claim 10 and said fulcrum projecting outwardly from said sleeve and providing a pouring lip.

12. The invention according to claim 10 and said fulcrum being disposed radially outwardly of said lever.

13. The invention according to claim 10 and said lever initially engaging with its end the top end of said fulcrum and then sliding off the top end and engaging with its top side the top end of the fulcrum as the lever is swung beyond 90° from its position laying flat on top of the plug.

* * * * *